US009985368B2

(12) United States Patent
Deng et al.

(10) Patent No.: US 9,985,368 B2
(45) Date of Patent: May 29, 2018

(54) ELECTRICAL CONNECTOR

(71) Applicant: Molex, LLC, Lisle, IL (US)

(72) Inventors: Jun Deng, Chengdu (CN); Masahiro Sakano, Yamato (JP); Cheng-Bing Qiu, Chengdu (CN)

(73) Assignee: Molex, LLC, Lisle, IL (US)

( * ) Notice: Subject to any disclaimer, the term of this patent is extended or adjusted under 35 U.S.C. 154(b) by 0 days. days.

(21) Appl. No.: 15/392,480

(22) Filed: Dec. 28, 2016

(65) Prior Publication Data

US 2017/0214160 A1 Jul. 27, 2017

(30) Foreign Application Priority Data

Jan. 22, 2016 (CN) ..... 2016 1 0046193

(51) Int. Cl.
*H01R 12/71* (2011.01)
*H01R 13/24* (2006.01)
*H01R 105/00* (2006.01)

(52) U.S. Cl.
CPC ..... *H01R 12/714* (2013.01); *H01R 13/2407* (2013.01); *H01R 13/2435* (2013.01); *H01R 2105/00* (2013.01)

(58) Field of Classification Search
CPC ..... H01R 12/714; H01R 13/2407; H01R 2105/00
USPC ..... 439/65
See application file for complete search history.

(56) References Cited

U.S. PATENT DOCUMENTS 5,040,999 A * 8/1991 Collier ..... H01R 12/714 439/108
5,052,936 A * 10/1991 Biechler ..... H01R 12/725 439/260
5,092,783 A * 3/1992 Suarez ..... H01R 4/48 439/66
5,137,454 A * 8/1992 Baechtle ..... H01R 12/57 439/267
5,286,215 A * 2/1994 Dewey ..... H01R 12/721 439/188
5,496,180 A * 3/1996 Fabian ..... H01R 4/028 439/60
6,042,386 A * 3/2000 Cohen ..... H01R 13/502 439/108

(Continued)

FOREIGN PATENT DOCUMENTS

CN 203859328 U 10/2014
JP 54-045958 U1 3/1979

(Continued)

*Primary Examiner* — Alexander Gilman
(74) *Attorney, Agent, or Firm* — James A. O'Malley

(57) ABSTRACT

An electrical connector comprises an insulative housing and a plurality of conductive terminals. The terminals are respectively provided in grooves of the housing. Each terminal has a portion fixed to the housing, an upper elastic portion extending from a top end of the fixed portion and a lower elastic portion extending from a bottom end of the fixed portion. The upper portion has a first arm extending from the fixed portion, a first contact section extending from the first arm, extending out of a top surface of the housing and bending, and a second arm extending from the first section, and a distal end of the second arm abuts against abutted structures in the corresponding groove when the first section is pressed down.

12 Claims, 9 Drawing Sheets

(56) References Cited

U.S. PATENT DOCUMENTS 6,213,804 B1 * 4/2001 Matsumura ..... H01R 12/87 439/267
6,302,727 B1 * 10/2001 Fedorjaka ..... H01R 13/2442 439/500
6,406,305 B1 * 6/2002 Wu ..... H01R 12/52 439/629
6,416,342 B2 * 7/2002 Matsumura ..... H01R 12/87 439/267
6,623,316 B1 * 9/2003 Wu ..... H01R 12/7082 439/188
6,695,628 B2 * 2/2004 Yeh ..... H01R 13/2442 439/500
6,851,986 B2 * 2/2005 Zhao ..... H01R 13/2435 439/595
6,875,049 B2 * 4/2005 Kyowski ..... H01R 11/282 439/500
7,063,540 B2 * 6/2006 Sun ..... H01R 12/714 439/500
7,122,274 B2 * 10/2006 Oe ..... H01M 2/1066 429/123
7,390,208 B1 * 6/2008 Sabo ..... H01R 12/57 439/260
7,390,229 B2 * 6/2008 Huang ..... H01R 11/282 439/862
7,611,391 B2 * 11/2009 Long ..... H01R 13/2435 439/500
7,896,661 B2 * 3/2011 Yao ..... H01R 12/716 439/62
8,070,498 B2 * 12/2011 Shen ..... H01R 13/2492 439/66
9,543,681 B2 * 1/2017 Chen ..... H01R 13/2457
2003/0224632 A1 * 12/2003 Regnier ..... H01R 13/6474 439/79

FOREIGN PATENT DOCUMENTS

JP 2002-093500 A 3/2002
JP 2002-124339 A 4/2002
JP 2007-005142 A 1/2007

* cited by examiner

ELECTRICAL CONNECTOR

RELATED APPLICATIONS

This application claims priority to Chinese Application No. 201610046193.3, filed Jan. 22, 2016, which is incorporated herein by reference in its entirety.

TECHNICAL FIELD

The present disclosure relates to an electrical connector, and particularly relates to an electrical connector used to electrically connect two circuit boards which are perpendicular to each other.

BACKGROUND ART

An electrical connector used to electrically connect two circuit boards which are perpendicular to each other is disclosed in, for example, Taiwanese Patent TWM496594U (corresponding to Chinese Patent Application CN01265368.3 and United States Patent U.S. Pat. No. 6,406,305). The electrical connector comprises an insulative housing and a plurality of terminal groups provided to the insulative housing, each terminal group comprises a first terminal and a second terminal. The first terminal has a first arm portion used to contact a first circuit board and a second arm portion used to contact a second circuit board. The second terminal has an engaging portion corresponding to the second arm portion, and the second circuit board is clamped between the engaging portion and the second arm portion.

The first arm portion and the second arm portion of the first terminal each are a single cantilevered arm and each contact the circuit board in a compression contact manner, in some devices and application environment thereof, such as in an oil force detecting device, a contact force in such a compression contact manner is insufficient and in turn the first terminal with such a configuration cannot be used in devices and application environments in which the requirement is more strict.

SUMMARY

Therefore, an object of the present disclosure is to provide an electrical connector which can increase a contact force between a conductive terminal and a circuit board.

Accordingly, in some embodiments, an electrical connector of the present disclosure comprises an insulative housing and a plurality of conductive terminals. The insulative housing has a top surface, a bottom surface, a circuit board slot recessed from the bottom surface towards the top surface and a plurality of terminal grooves arranged in a direction transverse to the circuit board slot, and each groove wall defining the terminal groove is formed with an abutted structure. The plurality of conductive terminals are respectively provided in the plurality of terminal grooves. Each conductive terminal has a fixed portion fixed to the insulative housing, an upper elastic portion extending from a top end of the fixed portion and a lower elastic portion extending from a bottom end of the fixed portion. The upper elastic portion has a first arm extending from the fixed portion, a first contact section extending from the first arm, extending out of the top surface and bending, and a second arm extending from the first contact section, and a distal end of the second arm abuts against the abutted structures in the corresponding terminal groove when the first contact section is pressed down. The lower elastic portion bends from the bottom end of the fixed portion and extends obliquely and upwardly and a distal end of the lower elastic portion is formed as a second contact section protruding into the circuit board slot.

In some embodiments, the first arm of the upper elastic portion of each conductive terminal extends obliquely and upwardly from the top end of the fixed portion, the first contact section bends from the first arm and extends downwardly, the second arm extends obliquely and downwardly from the first contact section towards the fixed portion.

In some embodiments, the distal end of the second arm of the upper elastic portion of each conductive terminal is formed as an abutting-against section which protrudes at two sides of the second arm and bends, and two sides of the abutting-against section abut against the two abutted structures in the corresponding terminal groove respectively when the first contact section is pressed down.

In some embodiments, the upper elastic portion and the lower elastic portion of each conductive terminal extend towards the same side of the fixed portion, every two adjacent conductive terminals are provided reversely, and the two fixed portions of every two conductive terminals are staggered and positioned respectively at two sides of the circuit board slot, which allows the two upper elastic portions of every two adjacent conductive terminals to be staggered and respectively extend obliquely from the two sides of the circuit board slot toward the middle of the circuit board slot and allows the two lower elastic portions of every two adjacent conductive terminals to be staggered and respectively extend obliquely from the two sides of the circuit board slot towards the middle of the circuit board slot.

In some embodiments, each terminal groove has an upper groove portion penetrating the top surface and a lower groove portion positioned below the upper groove portion and communicated with the circuit board slot.

In some embodiments, each abutted structure is a stepped structure which is formed on one of the two facing groove walls of the corresponding terminal groove.

In some embodiments, an electrical connector of the present disclosure is used to electrically connect a first circuit board and a second circuit board which are perpendicular to each other, and comprises an insulative housing and a plurality of conductive terminals. The insulative housing has a top surface which the first circuit board abuts against, a bottom surface, a circuit board slot recessed from the bottom surface towards the top surface for insertion of the second circuit board and a plurality of terminal grooves arranged in a direction transverse to the circuit board slot, and each groove wall defining the terminal groove is formed with an abutted structure. The plurality of conductive terminals are respectively provided in the plurality of terminal grooves. Each conductive terminal has a fixed portion fixed to the insulative housing, an upper elastic portion extending from a top end of the fixed portion and a lower elastic portion extending from a bottom end of the fixed portion. The upper elastic portion having a first arm extending from the fixed portion, a first contact section extending from the first arm, extending out of the top surface and bending for contacting the first circuit board to establish an electrical connection, and a second arm extending from the first contact section, and a distal end of the second arm abuts against the abutted structures in the corresponding terminal groove when the first contact section is pressed down and contacts the first circuit board. The lower elastic portion bends from the bottom end of the fixed portion and extending obliquely and upwardly and a distal end of the lower elastic portion is formed as a second contact section protruding into the circuit board slot for contacting the second circuit board to establish an electrical connection.

In some embodiments, the first arm of the upper elastic portion of each conductive terminal extends obliquely and upwardly from the top end of the fixed portion, the first contact section bends from the first arm and extends downwardly, the second arm extends obliquely and downwardly from the first contact section towards the fixed portion.

In some embodiments, the distal end of the second arm of the upper elastic portion of each conductive terminal is formed as an abutting-against section which protrudes at two sides of the second arm and bends, and two sides of the abutting-against section abut against the two abutted structures in the corresponding terminal groove respectively when the first contact section is pressed down.

In some embodiments, the upper elastic portion and the lower elastic portion of each conductive terminal extend towards the same side of the fixed portion, every two adjacent conductive terminals are provided reversely, and the two fixed portions of every two conductive terminals are staggered and positioned respectively at two sides of the circuit board slot, which allows the two second contact sections of every two adjacent conductive terminals to be staggered and respectively press against two sides of the second circuit board.

The present disclosure at least has the following effects: the upper elastic portion of the conductive terminal has the first arm and the second arm and the distal end of the second arm abuts against the abutted structure of the insulative housing when the first contact section compressing contacts the first circuit board, so the contact force between the first contact section and the first circuit board can be increased. The lower elastic portion reversely bends from the bottom end of the fixed portion and extends towards the circuit board slot, so the contact force between the second contact section and the second circuit board can be increased. In other words, the compression contact between the conductive terminal and the first circuit board and the second circuit board is more stable.

BRIEF DESCRIPTION OF THE DRAWINGS

The other features and effects of the present disclosure will be apparent through embodiments with reference to the Figures, and in which.

DETAILED DESCRIPTION OF THE PREFERRED EMBODIMENTS

Figure 1:
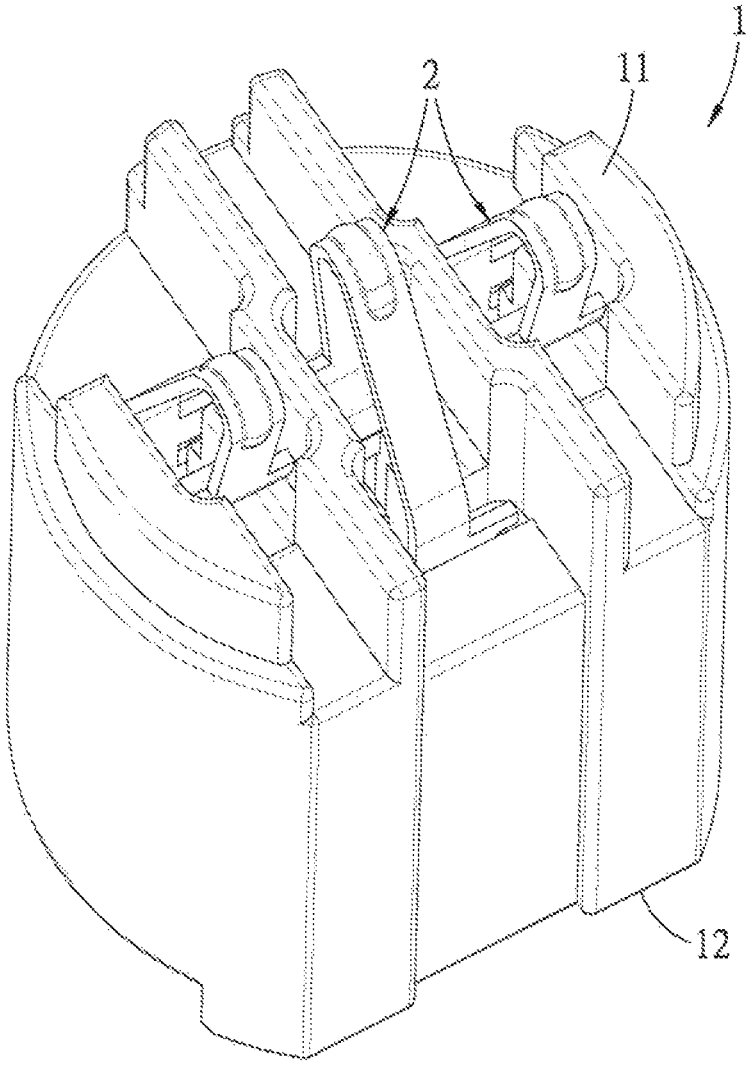
FIG. 1 is a perspective view of an electrical connector of an embodiment of the present disclosure.
Figure 2:
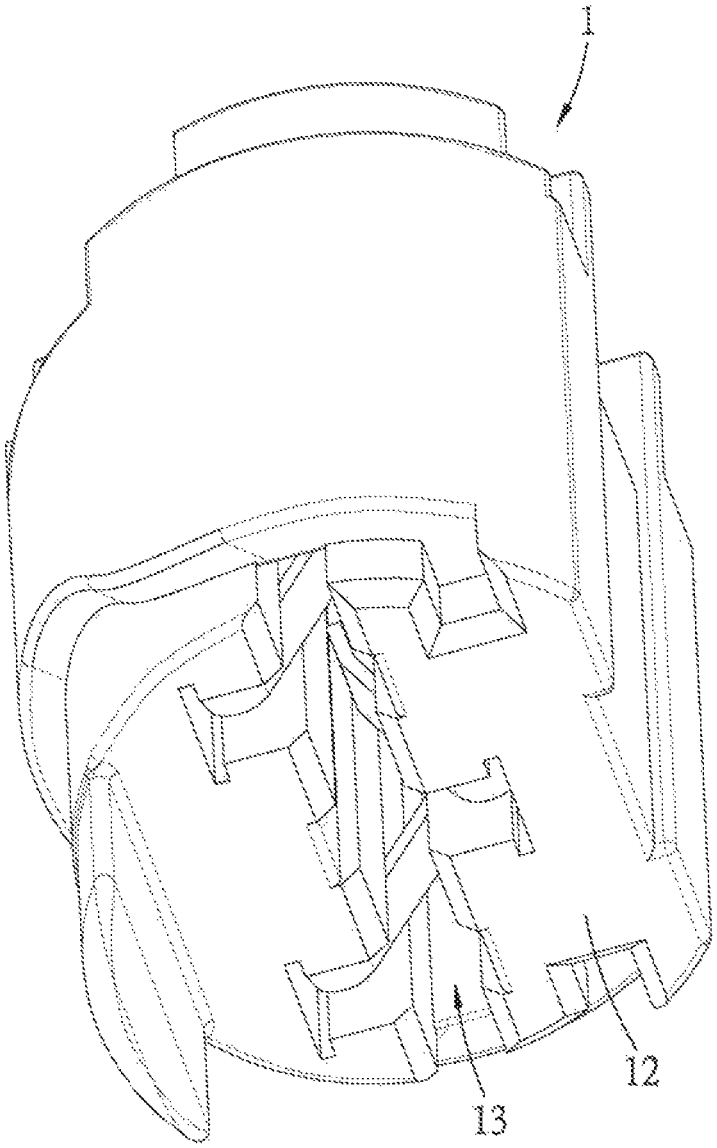
FIG. 2 is a perspective view of the embodiment viewed from another angle.
Figure 6:
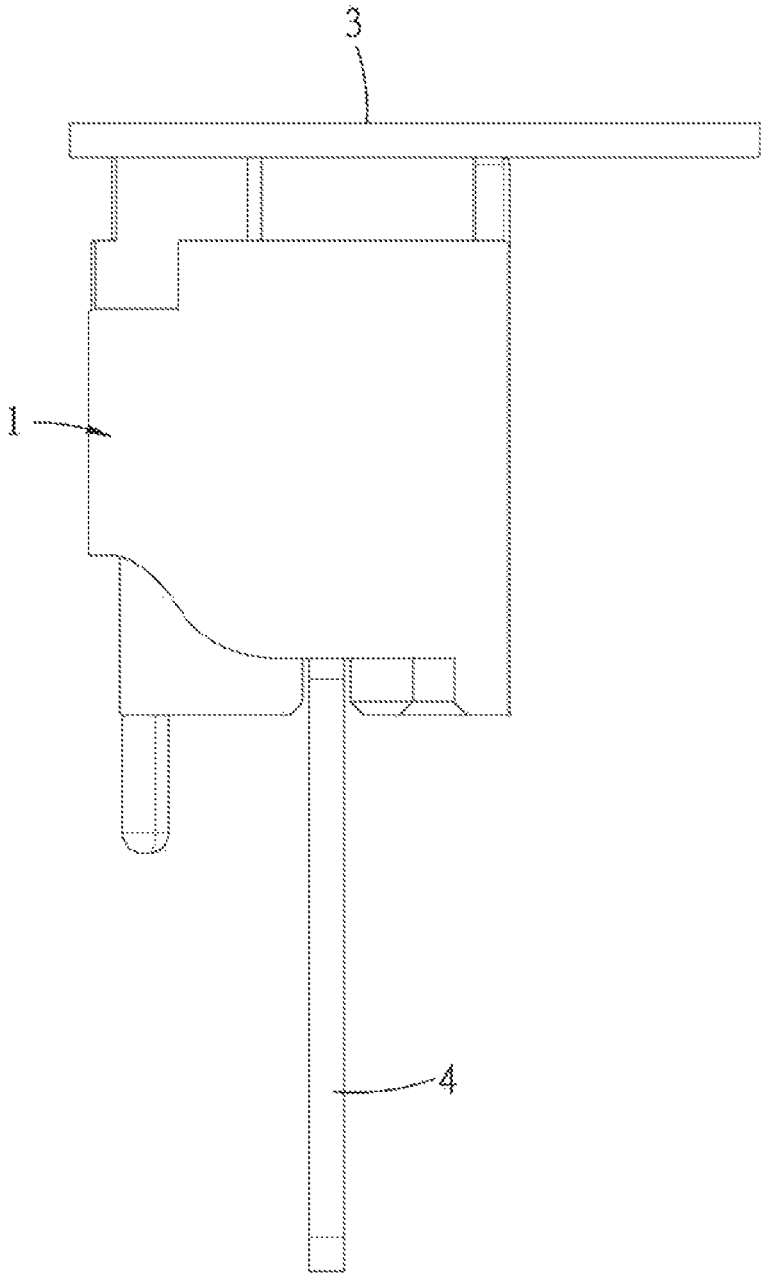
FIG. 6 is a side view of the embodiment connected with a first circuit board and a second circuit board.

Referring to FIG. 1, FIG. 2 and FIG. 6, an electrical connector of an embodiment of the present disclosure is used to electrically connect a first circuit board 3 and a second circuit board 4 which are perpendicular to each other, and comprises an insulative housing 1 and a plurality of conductive terminals 2.

Figure 3:
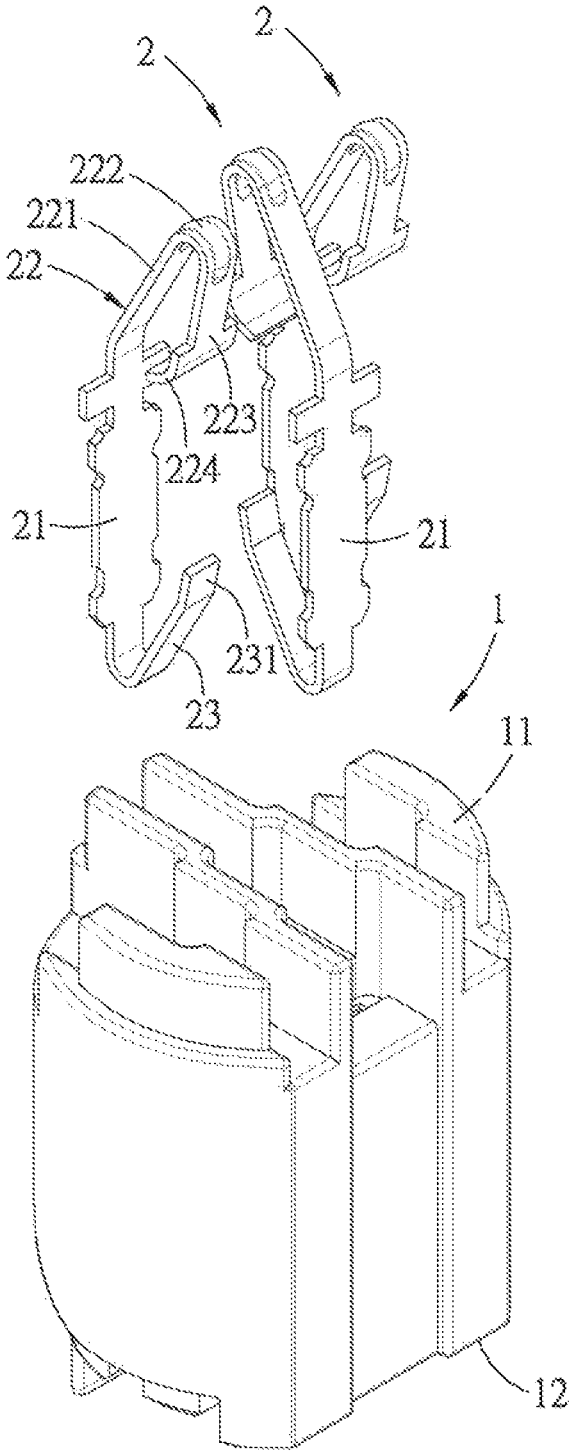
FIG. 3 is an exploded perspective view of the embodiment.
Figure 4:
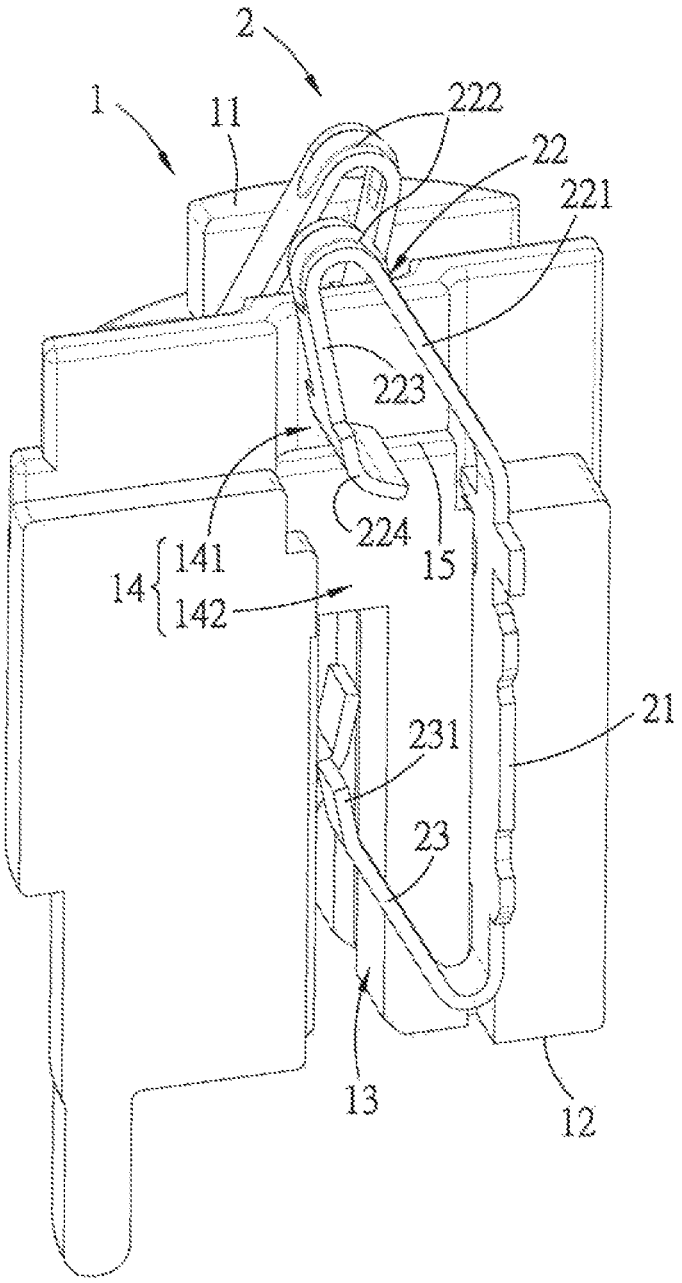
FIG. 4 is a partial perspective view of the embodiment.
Figure 5:
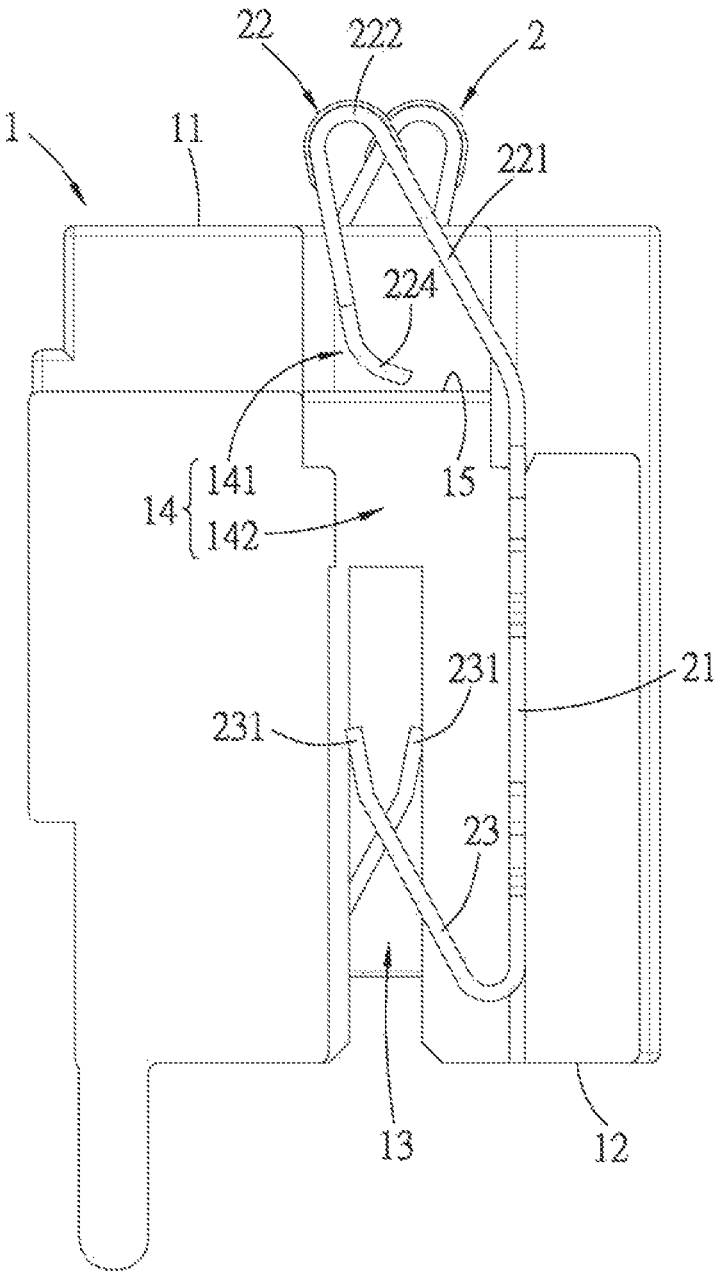
FIG. 5 is a side view of FIG. 4.

Further referring to FIG. 3 to FIG. 5, the insulative housing 1 has a top surface 11 which the first circuit board 3 abuts against, a bottom surface 12, a circuit board slot 13 recessed from the bottom surface 12 towards the top surface 11 for insertion of the second circuit board 4 and a plurality of terminal grooves 14 arranged in a direction transverse to the circuit board slot 13, and each groove wall defining the terminal groove 14 is formed with an abutted structure 15. In the embodiment, each terminal groove 14 has an upper groove portion 141 penetrating the top surface 11 and a lower groove portion 142 positioned below the upper groove portion 141 and communicated with the circuit board slot 13. Moreover, each abutted structure 15 is a stepped structure which is formed on one of the two facing groove walls of the corresponding terminal groove 14. In the embodiment, the abutted structure 15 is a step-shape between the upper groove portion 141 and the lower groove portion 142, but the abutted structure 15 is not limited to the step-shape, but may be a protruding block or other structure which can be abutted against.

The plurality of conductive terminals 2 are respectively provided in the plurality of terminal grooves 14, each conductive terminal 2 has a fixed portion 21 fixed to the insulative housing 1, an upper elastic portion 22 extending from a top end of the fixed portion 21 and a lower elastic portion 23 extending from a bottom end of the fixed portion 21. The upper elastic portion 22 has a first arm 221 extending from the fixed portion 21, a first contact section 222 extending from the first arm 221, extending out of the top surface 11 and bending, and a second arm 223 extending from the first contact section 222. The lower elastic portion 23 bends from the fixed portion 21 and extends obliquely and upwardly, and a distal end of the lower elastic portion 23 is formed as a second contact section 231 protruding into the circuit board slot 13. In the embodiment, the first arm 221 of the upper elastic portion 22 of each conductive terminal 2 extends obliquely and upwardly from the top end of the fixed portion 21, the first contact section 222 bends from the first arm 221 and extends downwardly, the second arm 223 extends obliquely and downwardly from the first contact section 222 towards the fixed portion 21, and a distal end of the second arm 223 is formed as an abutting-against section 224 which protrudes at two sides of the second arm 223 and bends. In the embodiment, the upper groove portion 141 and the lower groove portion 142 of each terminal groove 14 generally form a T-shape, the upper groove portion 141 further extends towards two sides relative to the lower groove portion 142, the upper elastic portion 22 of each conductive terminal 2 is positioned in the upper groove portion 141 of the corresponding terminal groove 14, and the fixed portion 21 and the lower elastic portion 23 of each conductive terminal 2 are positioned in the lower groove portion 142. The upper elastic portion 22 and the lower elastic portion 23 of each conductive terminal 2 extend towards the same side of the fixed portion 21, every two adjacent conductive terminals 2 are provided reversely, and the two fixed portions 21 of every two adjacent conductive terminals 2 are staggered and positioned respectively at two sides of the circuit board slot 13, which allows the two upper elastic portions 22 of every two adjacent conductive terminals 2 to be staggered and respectively extend obliquely from the two sides of the circuit board slot 13 towards the middle of the circuit board slot 13 and allows the two lower elastic portions 23 of every two adjacent conductive terminals 2 to be staggered and respectively extend obliquely from the two sides of the circuit board slot 13 towards the middle of the circuit board slot 13.

Figure 7:
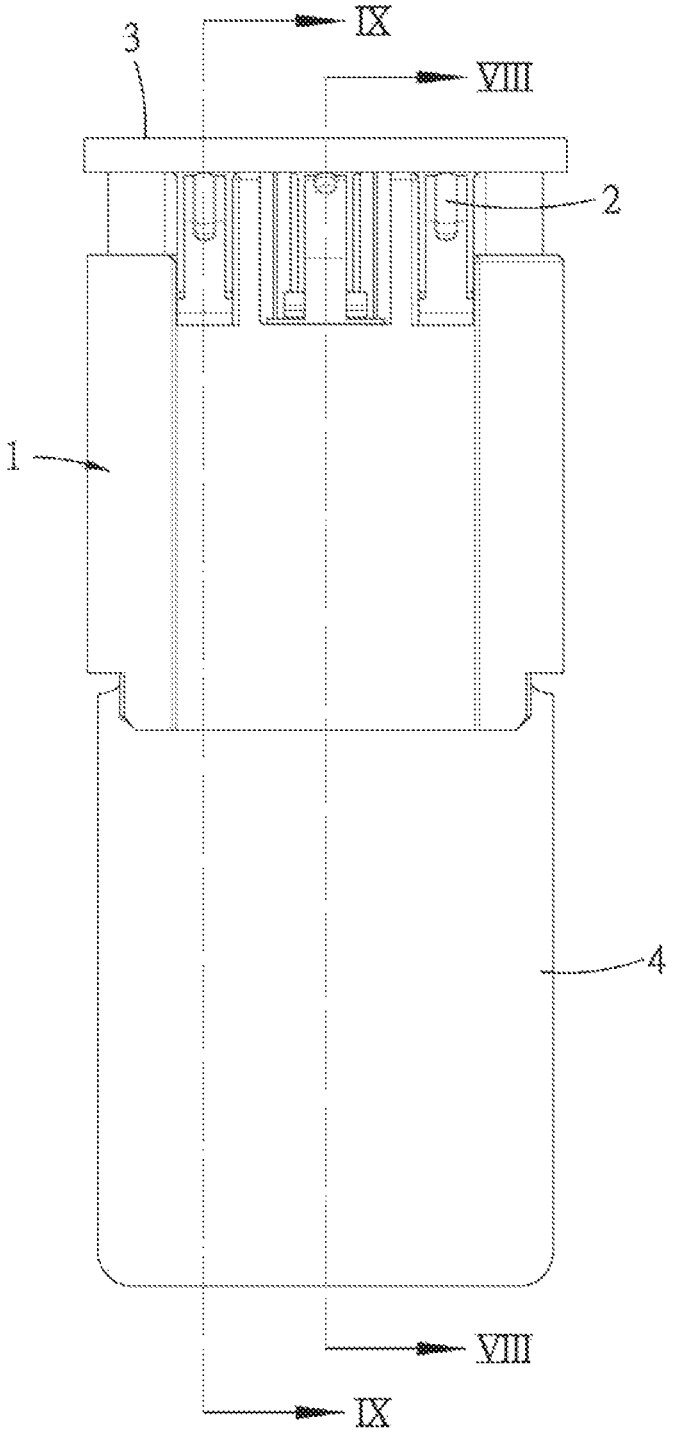
FIG. 7 is a side view similar to FIG. 6 and viewed from another angle.
Figure 8:
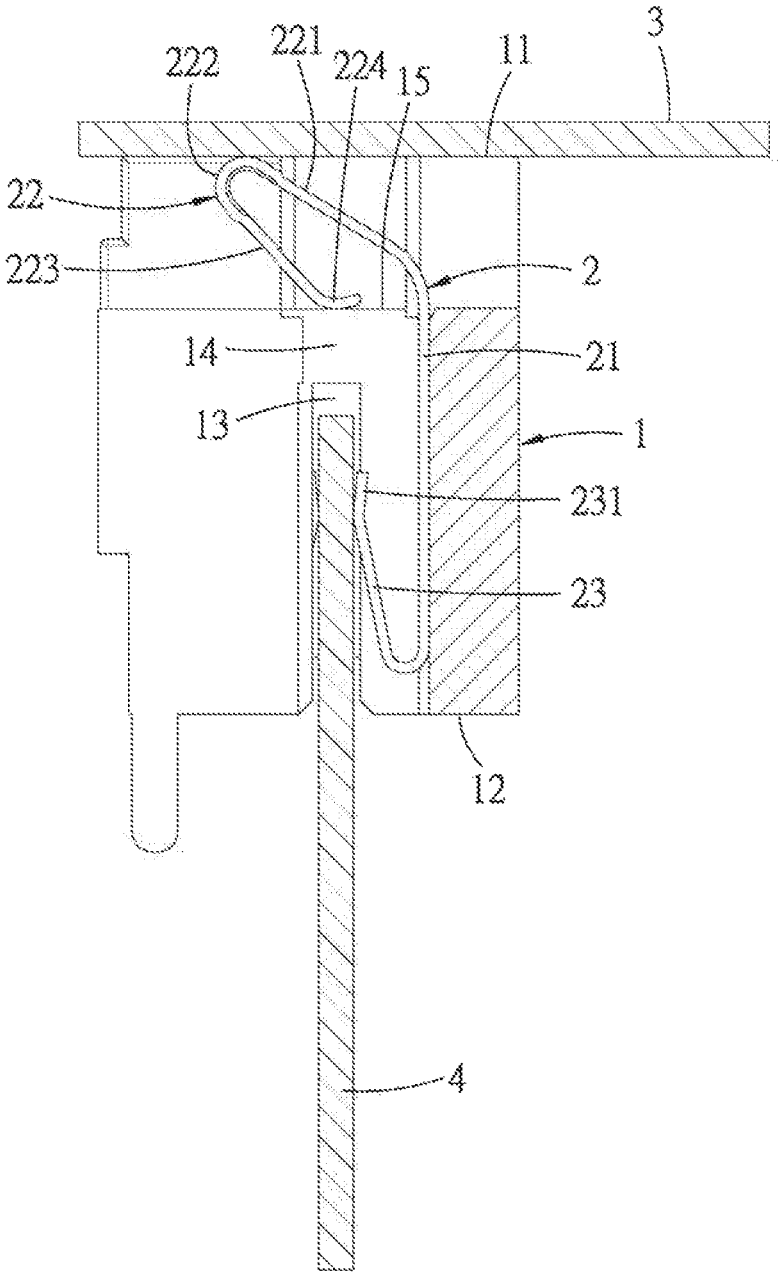
FIG. 8 is a cross-sectional view taken along a line VIII-VIII of FIG. 7.
Figure 9:
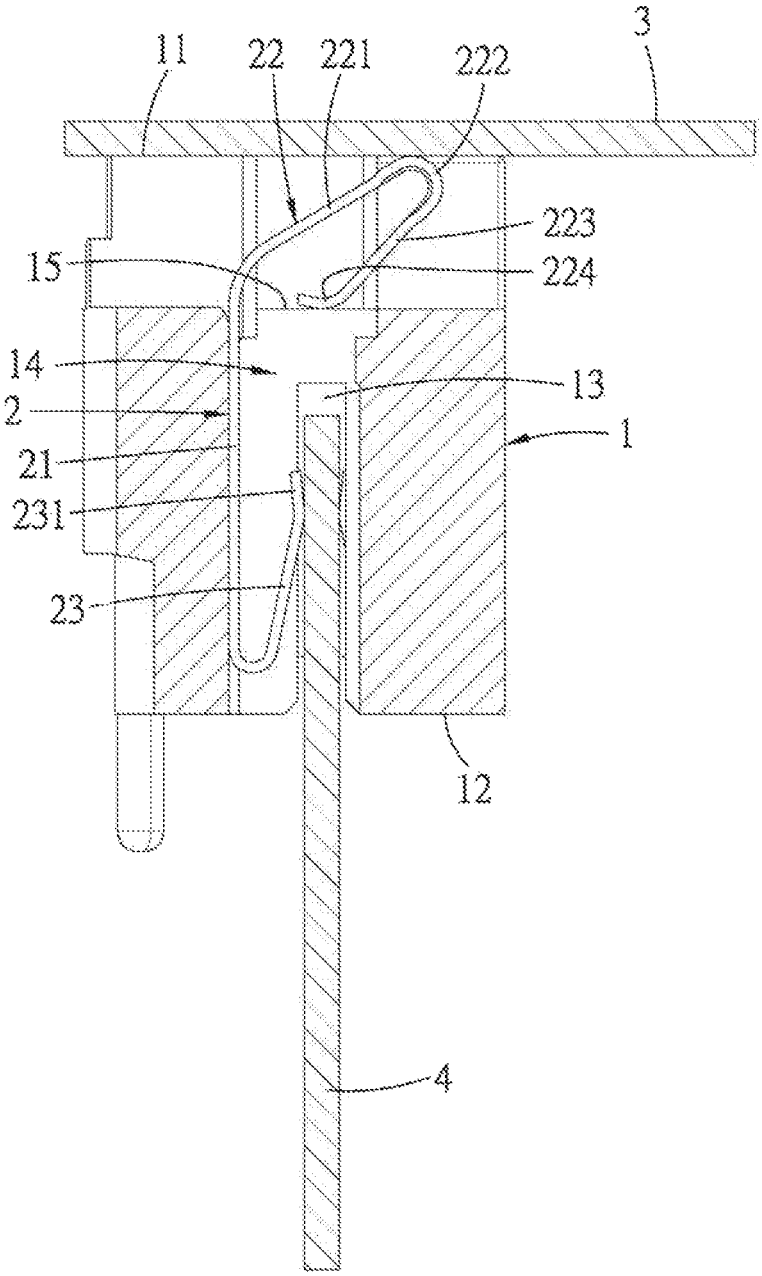
FIG. 9 is a cross-sectional view taken along a line IX-IX of FIG. 7.

Referring to FIG. 7 to FIG. 9, when the first circuit board 3 is pressed down and abuts against the top surface 11 of the insulative housing 1 and presses against the first contact sections 222 of the plurality of conductive terminals 2, the first contact sections 222 of the plurality of conductive terminals 2 contact the first circuit board 3 to establish an electrical connection. The distal end of the second arm 223 of each conductive terminal 2 abuts against the abutted structures 15 in the corresponding terminal groove 14 when the first contact section 222 is pressed down, that is, two sides of the abutting-against section 224 (see FIG. 4) abut against the two abutted structures 15 in the corresponding terminal groove 14 respectively when the first contact section 222 is pressed down, thereby increasing a contact force between the first contact section 222 and the first circuit board 3. When the second circuit board 4 is inserted into the circuit board slot 13, the second contact sections 231 of the plurality of conductive terminals 2 press against the second circuit board 4 and contact the second circuit board 4 to establish an electrical connection. The first circuit board 3 and the second circuit board 4 are electrically connected with each other via the plurality of conductive terminals 2. The lower elastic portion 23 bends reversely from the bottom end of the fixed portion 21 and extends towards the circuit board slot 13, so a contact force between the second contact section 231 and the second circuit board 4 can be increased. Moreover, the two fixed portions 21 of every two conductive terminals 2 are staggered and respectively positioned at the two sides of the circuit board slot 13 to allow the two second contact sections 231 of every two conductive terminals 2 to be staggered and respectively press against the two sides of the second circuit board 4, that is, the second circuit board 4 is clamped by the second contact sections 231 of the plurality of conductive terminals 2, so the stability of the second circuit board 4 can be increased when the second circuit board 4 is inserted into the circuit board slot 13.

In conclusion, the upper elastic portion 22 of the conductive terminal 2 has the first arm 221 and the second arm 223 and the distal end of the second arm 223 abuts against the abutted structure 15 of the insulative housing 1 when the first contact section 222 compressing contacts the first circuit board 3, so the contact force between the first contact section 222 and the first circuit board 3 can be increased. The lower elastic portion 23 reversely bends from the bottom end of the fixed portion 21 and extends towards the circuit board slot 13, so the contact force between the second contact section 231 and the second circuit board 4 can be increased. In other words, the compression contact between the conductive terminal 2 and the first circuit board 3 and the second circuit board 4 is more stable.

However, the above content only is the embodiment of the present disclosure, but is not intended to limit the scope of implementing the present disclosure, that is, simple equivalent changes and modifications made according to the claims and the specification of the present disclosure will be fallen within the scope of the present disclosure.

What is claimed is:

1. An electrical connector, the electrical connector comprising:

an insulative housing having a top surface, a bottom surface, a circuit board slot recessed from the bottom surface towards the top surface, and a plurality of terminal grooves arranged in a direction transverse to the circuit board slot, each terminal groove being defined by a groove wall which is formed with an abutted structure; and a plurality of conductive terminals respectively provided in the plurality of terminal grooves, each conductive terminal having a fixed portion fixed to the insulative housing, an upper elastic portion extending from a top end of the fixed portion and a lower elastic portion extending from a bottom end of the fixed portion, the upper elastic portion having a first arm extending from the fixed portion, a first contact section extending from the first arm, extending out of the top surface and bending, and a second arm extending from the first contact section, and a distal end of the second arm abutting against the abutted structures in the corresponding terminal groove when the first contact section is pressed down, the lower elastic portion bending from the bottom end of the fixed portion and extending obliquely and upwardly and a distal end of the lower elastic portion being formed as a second contact section protruding into the circuit board slot.

2. The electrical connector according to claim 1, wherein the first arm of the upper elastic portion of each conductive terminal extends obliquely and upwardly from the top end of the fixed portion, the first contact section bends from the first arm and extends downwardly, the second arm extends obliquely and downwardly from the first contact section towards the fixed portion.

3. The electrical connector according to claim 2, wherein the distal end of the second arm of the upper elastic portion of each conductive terminal is formed as an abutting-against section which protrudes at two sides of the second arm and bends, and two sides of the abutting-against section abut against the two abutted structures in the corresponding terminal groove respectively when the first contact section is pressed down.

4. The electrical connector according to claim 3, wherein the upper elastic portion and the lower elastic portion of each conductive terminal extend towards the same side of the fixed portion, every two adjacent conductive terminals are provided reversely, and the two fixed portions of every two conductive terminals are staggered and positioned respectively at two sides of the circuit board slot, which allows the two upper elastic portions of every two adjacent conductive terminals to be staggered and respectively extend obliquely from the two sides of the circuit board slot toward the middle of the circuit board slot and allows the two lower elastic portions of every two adjacent conductive terminals to be staggered and respectively extend obliquely from the two sides of the circuit board slot towards the middle of the circuit board slot.

5. The electrical connector according to claim 1, wherein each terminal groove has an upper groove portion penetrating the top surface and a lower groove portion positioned below the upper groove portion and communicated with the circuit board slot.

6. The electrical connector according to claim 5, wherein each abutted structure is a stepped structure which is formed on one of the two facing groove walls of the corresponding terminal groove.

7. An electrical connector used to electrically connect a first circuit board and a second circuit board which are perpendicular to each other, the electrical connector comprising:

an insulative housing having a top surface which the first circuit board abuts against, a bottom surface, a circuit board slot recessed from the bottom surface towards the top surface for insertion of the second circuit board and a plurality of terminal grooves arranged in a direction transverse to the circuit board slot, and each terminal groove being defined by a groove wall which is formed with an abutted structure; and a plurality of conductive terminals respectively provided in the plurality of terminal grooves, each conductive terminal having a fixed portion fixed to the insulative housing, an upper elastic portion extending from a top end of the fixed portion and a lower elastic portion extending from a bottom end of the fixed portion, the upper elastic portion having a first arm extending from the fixed portion, a first contact section extending from the first arm, extending out of the top surface and bending for contacting the first circuit board to establish an electrical connection, and a second arm extending from the first contact section, and a distal end of the second arm abutting against the abutted structures in the corresponding terminal groove when the first contact section is pressed down and contacts the first circuit board, the lower elastic portion bending from the bottom end of the fixed portion and extending obliquely and upwardly and a distal end of the lower elastic portion being formed as a second contact section protruding into the circuit board slot for contacting the second circuit board to establish an electrical connection.

8. The electrical connector according to claim 7, wherein the first arm of the upper elastic portion of each conductive terminal extends obliquely and upwardly from the top end of the fixed portion, the first contact section bends from the first arm and extends downwardly, the second arm extends obliquely and downwardly from the first contact section towards the fixed portion.

9. The electrical connector according to claim 8, wherein the distal end of the second arm of the upper elastic portion of each conductive terminal is formed as an abutting-against section which protrudes at two sides of the second arm and bends, and two sides of the abutting-against section abut against the two abutted structures in the corresponding terminal groove respectively when the first contact section is pressed down.

10. The electrical connector according to claim 9, wherein the upper elastic portion and the lower elastic portion of each conductive terminal extend towards the same side of the fixed portion, every two adjacent conductive terminals are provided reversely, and the two fixed portions of every two conductive terminals are staggered and positioned respectively at two sides of the circuit board slot, which allows the two second contact sections of every two adjacent conductive terminals to be staggered and respectively press against two sides of the second circuit board.

11. The electrical connector according to claim 7, wherein each terminal groove has an upper groove portion penetrating the top surface and a lower groove portion positioned below the upper groove portion and communicated with the circuit board slot.

12. The electrical connector according to claim 11, wherein each abutted structure is a stepped structure which is formed on one of the two facing groove walls of the corresponding terminal groove.

* * * * *